US006817200B2

(12) United States Patent
Willamor et al.

(10) Patent No.: US 6,817,200 B2
(45) Date of Patent: Nov. 16, 2004

(54) SPLIT ICE MAKING AND DELIVERY SYSTEM FOR MARITIME AND OTHER APPLICATIONS

(76) Inventors: Marty Willamor, 6450 Lake Victoria Dr., Theodore, AL (US) 36582-5048; Joseph E. Jefferson, Jr., 907 Delchamps Ave., Dauphin Island, AL (US) 36528

( * ) Notice: Subject to any disclaimer, the term of this patent is extended or adjusted under 35 U.S.C. 154(b) by 494 days.

(21) Appl. No.: 09/966,938

(22) Filed: Oct. 1, 2001

(65) Prior Publication Data

US 2004/0093888 A1 May 20, 2004

(51) Int. Cl.[7] ..... F25C 1/14
(52) U.S. Cl. ..... 62/240; 62/354
(58) Field of Search ..... 62/239–244, 259.1, 62/298, 354

(56) References Cited

U.S. PATENT DOCUMENTS 4,276,751 A * 7/1981 Saltzman et al. ..... 62/138
4,922,724 A * 5/1990 Grayson et al. ..... 62/135
5,787,723 A * 8/1998 Mueller et al. ..... 62/347
6,196,007 B1 * 3/2001 Schlosser et al. ..... 62/73
6,691,528 B2 * 2/2004 Stensrud et al. ..... 62/344

* cited by examiner

*Primary Examiner*—William E. Tapolcai
(74) *Attorney, Agent, or Firm*—McNair Law Firm, P.A.; Cort Flint

(57) ABSTRACT

A split ice making and delivery system which includes a condenser and compressor sub-assembly which compresses and condenses refrigerant and a compact remote ice making sub-assembly. The remote ice making assembly may be integrated with an ice storage bin. The system further includes a refrigerant delivery sub-assembly coupled to the condenser and compressor sub-assembly and the remote ice making sub-assembly for delivering therebetween the refrigerant. The refrigerant delivery sub-assembly has a length sufficient to reach a upper level of a marine vessel, a remote room, or remote location to reach the remote ice making sub-assembly remote from the condenser and compressor sub-assembly.

20 Claims, 4 Drawing Sheets

SPLIT ICE MAKING AND DELIVERY SYSTEM FOR MARITIME AND OTHER APPLICATIONS

BACKGROUND OF THE INVENTION

1. Field of the Invention

The present invention relates to ice makers for marine vessels and recreational vehicles (RV) and other applications, and, more particularly, to a split marine ice making and delivery system which locates the ice making sub-assembly adjacent or in close proximity to the ice storage bin and away from the condenser unit or compressor unit.

2. General Background

Presently, refrigerant systems for marine applications are made of a single unit which pushes ice threw long tubes which frequently clog such as, when pieces of ice adhere together. Moreover, such refrigerant systems are relatively noisy as the ice is pushed to remote locations 20, 30, and 40 of feet away.

For example, U.S. Pat. No. 4,922,724, issued to Grayson, et al., entitled "MARINE ICE MAKING AND DELIVERY SYSTEM" discloses a refrigeration circuit located on the engine deck of a marine craft having an ice making assembly and a flexible conduit coupled to the output of the ice making assembly. The flexible conduit has a length sufficient to reach upper levels of the marine craft and reaches horizontally remote locations from the refrigeration circuit to deliver ice.

U.S. Pat. Nos. 4,576,016 and 4,574,593, issued to Nelson, entitled "ICE MAKING APPARATUS" discloses a combination evaporator and auger-type ice-forming assembly operatively disposed between an ice product receiving area and a drive means assembly.

U.S. Pat. No. 4,433,559, issued to King-Seeley Thermos Co., entitled "ICE MAKING APPARATUS" discloses an ice-making apparatus having a rotatable auger and a helical evaporator. The output of the ice-making apparatus is delivered to an extruder mechanism which causes flaked ice from the ice-making apparatus to be compacted or compresses and formed into discrete ice bodies or cubes. The ice bodies or cubes are delivered to a storage bin via a conduit.

As can be appreciated there is a continuing need for a split ice making and delivery system which eliminates forcing through very long conduits ice product which oftentimes becomes clogged.

As will be seen more fully below, the present invention is substantially different in structure, methodology and approach from that of the prior refrigeration systems.

SUMMARY OF THE PRESENT INVENTION

The preferred embodiment of split ice making and delivery system of the present invention solves the aforementioned problems in a straight forward and simple manner.

Broadly, the present invention contemplates a split ice making and delivery system comprising: a condenser and compressor sub-assembly which compresses and condenses refrigerant; a remote ice making sub-assembly having a rotating auger, a fresh water freeze chamber adapted to be filled with portable fresh water and an outlet wherein rotation of said auger forces out, of said outlet, ice product; and, a refrigerant delivery sub-assembly coupled to said condenser and compressor sub-assembly and said remote ice making sub-assembly for delivering therebetween said refrigerant wherein said refrigerant delivery sub-assembly has a length sufficient to reach a remote room or remote location and to reach said remote ice making sub-assembly remote from said condenser and compressor sub-assembly.

In view of the above, an object of the present invention is to provide a split ice making and delivery system comprising an ice storage bin which is located in close proximity to the remote ice making sub-assembly; and, means for channeling ice product from the remote ice making sub-assembly to the ice storage bin wherein the ice channeling means has a length less than 10 feet.

Another object of the present invention is to provide a split ice making and delivery system having a remote ice making sub-assembly which is capable of producing 380–500 pounds of ice per day.

A further object of the present invention is to provide a split ice making and delivery system having a combination remote ice making sub-assembly and ice storage bin wherein the remote ice making sub-assembly includes a compact housing for storing the remote ice making sub-assembly wherein the housing has a height of approximately 29½ inches and a width and depth of 12 inches.

A still further object of the present invention is to provide a split ice making and delivery system having a remote ice making assembly which includes an evaporator coiled around an auger having a refrigerant inlet line receiving refrigerant from via a refrigerant delivery line of the refrigerant delivery sub-assembly from the condenser and compressor sub-assembly to the refrigerant inlet line and a refrigerant outlet line expels spent refrigerant on return refrigerant delivery line to the condenser and compressor sub-assembly.

A still further object of the present invention is to provide a split ice making and delivery system having a control temperature sensor integrated into or affixed to an ice storage bin wherein as the ice product reaches a predetermined level, a decrease in temperature is realized at the control temperature sensor and the condenser and compressor sub-assembly and the remote ice making sub-assembly are deactivated.

A still further object of the present invention is to provide a split ice making and delivery system having a thermo-expansion valve in-line between the remote ice making sub-assembly and the condenser and compressor sub-assembly.

In view of the above, a feature of the present invention is to provide a split ice making and delivery system which eliminates long conduits through which ice is channeled to a remote ice storage bin.

Another feature of the present invention is to provide a split ice making and delivery system which minimizes the operating noise.

A further feature of the present invention is to provide a split ice making and delivery system which channels through long conduits refrigerant to remote location in a marine vessel or craft or RV.

A still further feature of the present invention is to provide a split ice making and delivery system which includes a water cooled condenser unit for marine applications wherein raw water from about the marine vessel is used or an air cooled condenser unit is used for RV applications.

The above and other objects and features of the present invention will become apparent from the drawings, the description given herein, and the appended claims.

BRIEF DESCRIPTION OF THE DRAWING

For a further understanding of the nature and objects of the present invention, reference should be had to the following description taken in conjunction with the accompanying drawings in which like parts are given like reference numerals and, wherein.

DETAILED DESCRIPTION OF THE PREFERRED EMBODIMENT

Figure 1:
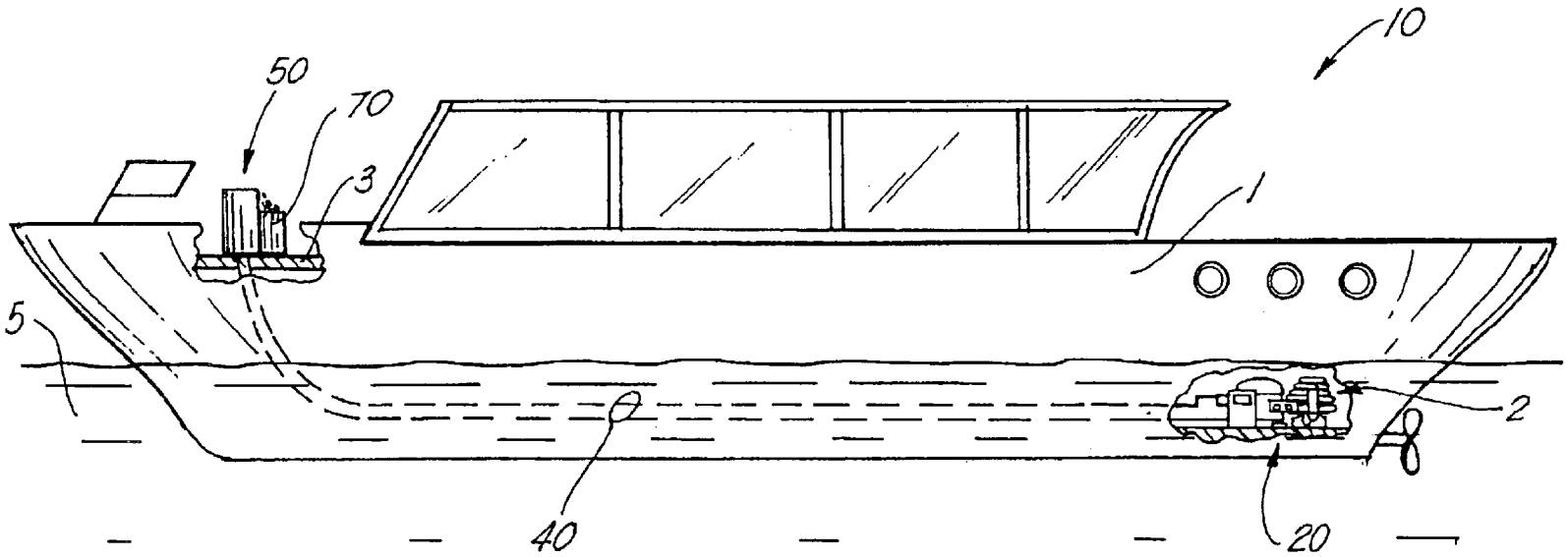
FIG. 1 illustrates a view of the split ice making and delivery system of the present invention deployed on a marine vessel.
Figure 2:
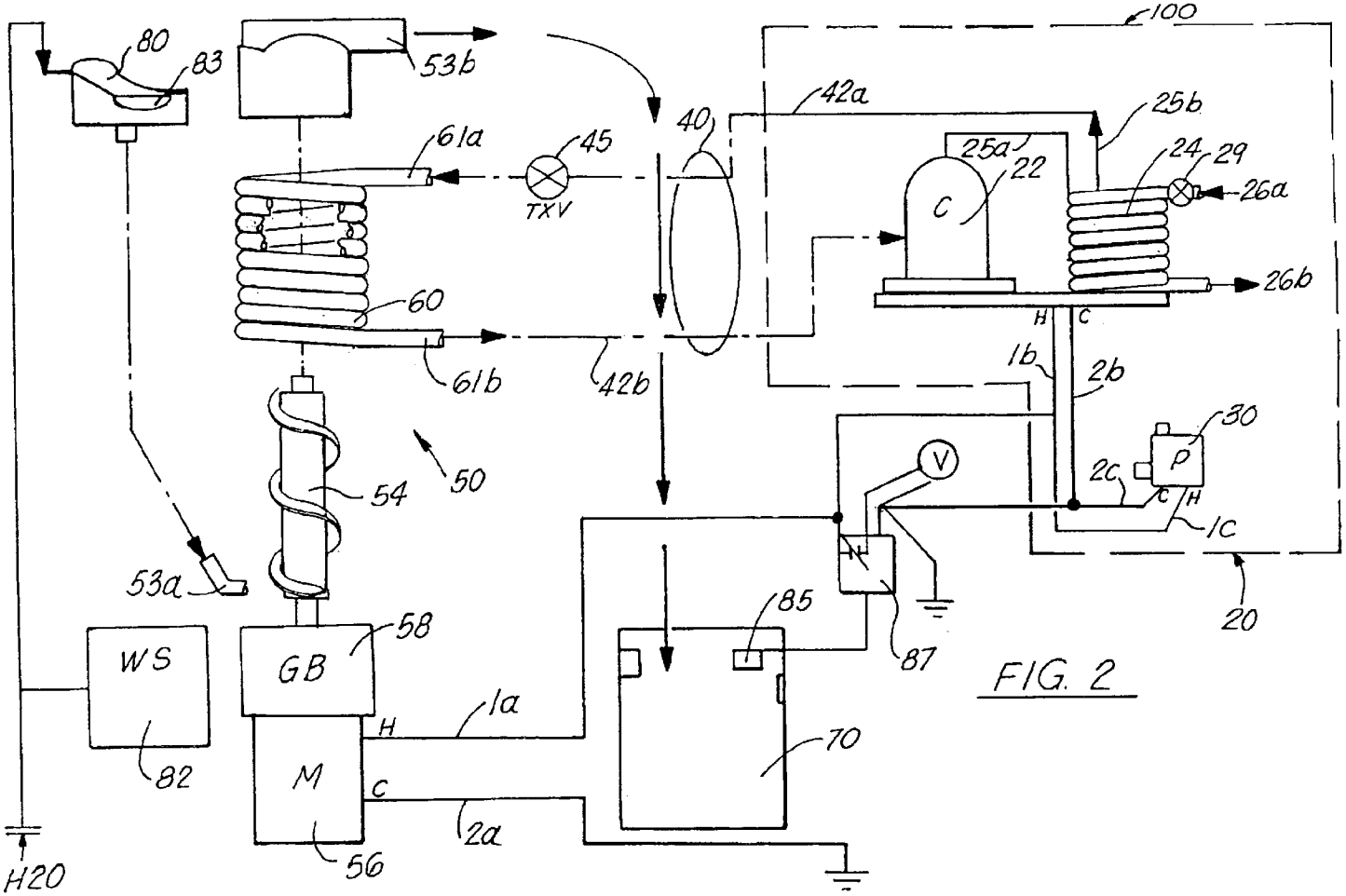
FIG. 2 illustrates a general schematic diagram of the refrigeration circuit of the split ice making and delivery system of the present invention.
Figure 4:
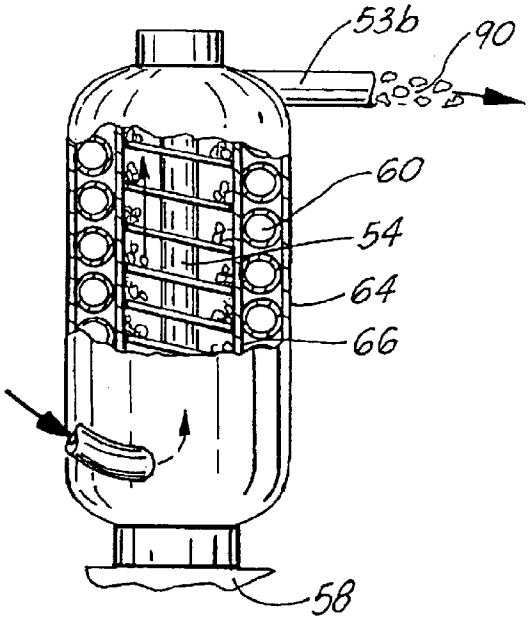
FIG. 4 illustrates a cross sectional view along the PLANE 4—4 of FIG. 5.
Figure 3:
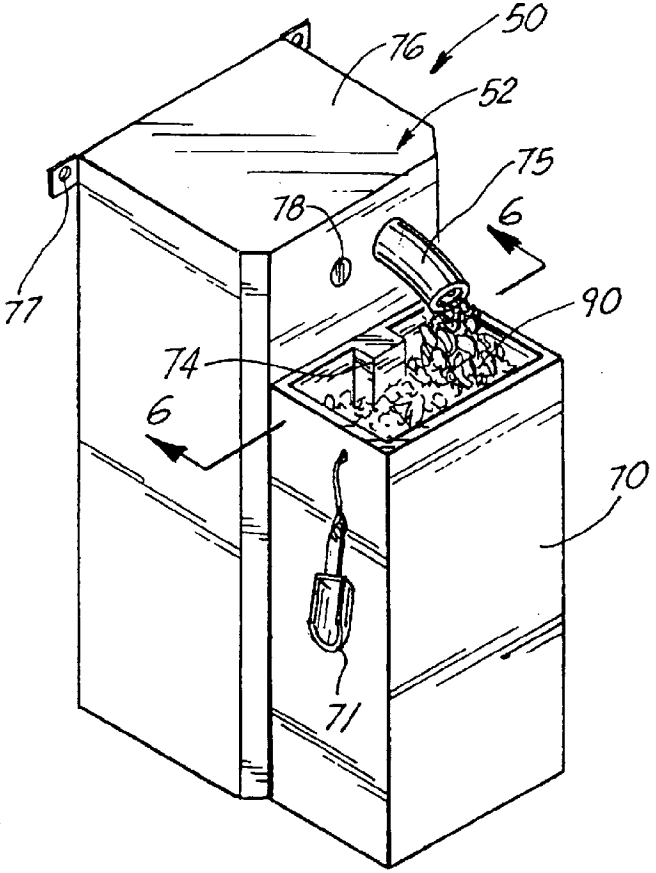
FIG. 3 illustrates a perspective view of the remote ice making sub-assembly in combination with an ice bin of the present invention.
Figure 5:
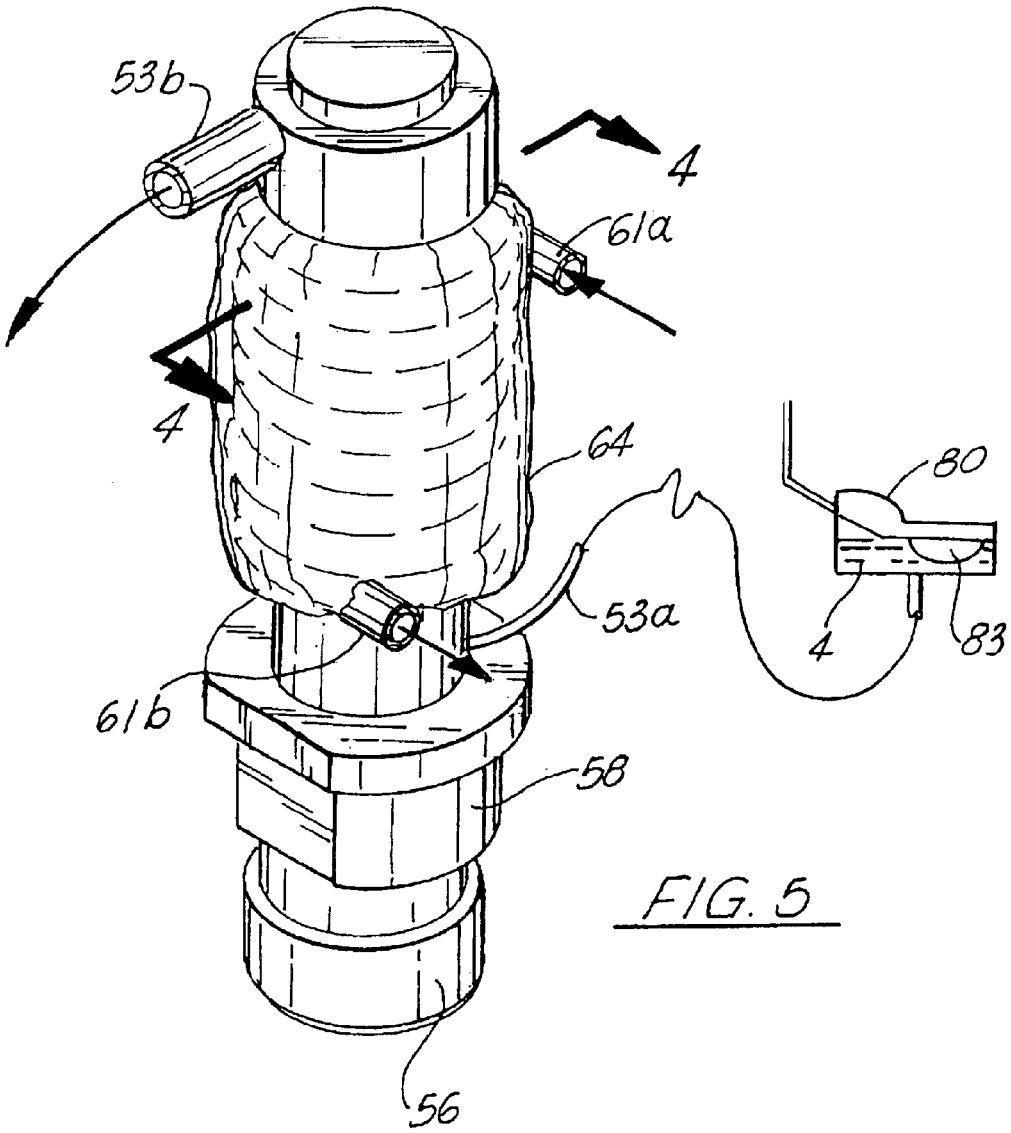
FIG. 5 illustrates a perspective the internal components of the remote ice making sub-assembly; and, FIG. 6 illustrates a cross-sectional view along the PLANE 6—6 of FIG. 3.

Referring now to the drawings and in particular FIGS. 2–5, the split ice making and delivery system of the present invention is generally referenced by the numeral 10. The split marine ice making and delivery system 10 is generally comprised of a compressor and condenser sub-assembly 20 in fluid communication with a remote ice making sub-assembly 50 via a refrigerant delivery sub-assembly 40. The split marine ice making and delivery system 10 may further include an ice storage bin 70 or it may stand alone. The ice storage bin 70 includes a ice scoop or ladle 71.

Referring now to FIG. 1, the split marine ice making and delivery system 10 is adapted for marine applications wherein the refrigeration circuit 100 of the split ice making and delivery system 10 is split into two general sub-assemblies, the compressor and condenser (compressor/condenser) sub-assembly 20 and the remote ice making sub-assembly 50 adapted to be separated by many feet, compartments or floors of a marine vessel 1 via a refrigerant delivery sub-assembly 40. In an alternate embodiment, the split marine ice making and delivery system 10 is adapted for RV applications. The term "transoort vehicle" as used herein means any means for conveying or moving persons or something over land, air, or water.

In the marine application, the compressor and condenser sub-assembly 20 is adapted to be deployed in the engine room 2 where raw water or sea water is easily accessible while the remote ice making sub-assembly 50 is adapted to be located in another compartment or floor 3 remote from the engine room 2. Since, the remote ice making sub-assembly 50 is in fluid communication with the compressor and condenser sub-assembly 20 via the refrigerant delivery sub-assembly 40, the ice 90 does not have to be communicated remotely to the ice storage bin 70 on the marine vessel. Instead, the refrigerant fluid having a natural tendency to flow is easily communicated remotely in the refrigerant delivery sub-assembly 40 between the compressor and condenser sub-assembly 20 and the remote ice making sub-assembly 50. Hence, clogging ice in such long conduits is eliminated.

Additionally, locating the compressor and condenser sub-assembly 20 in the engine room 2 or other location minimizes the impact of the operational noise therefrom on the occupants of the marine vessel 1.

Figure 6:
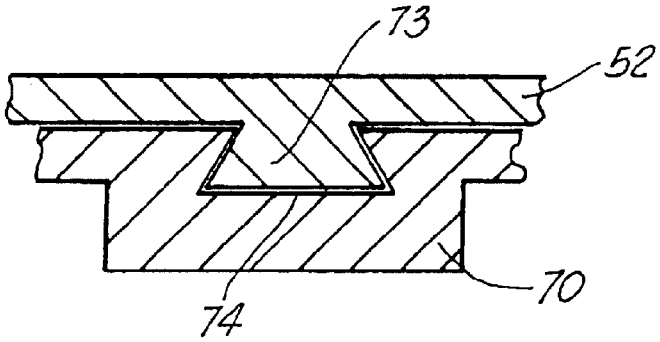

Referring now to FIGS. 3–6, the remote ice making sub-assembly 50 is housed in housing unit 52. The remote ice making sub-assembly 50 and housing unit 52 are compact and are designed to be located in close proximity to the ice storage bin 70. In the exemplary embodiment, the housing unit 52 has affixed thereto the ice storage bin 70. As best seen in FIG. 6, the housing unit 52 has mounted to a front surface thereof a first coupler or rail 73. The ice storage bin 70 comprises a second coupler or channel guide 74 adapted to connect to or mate with the first coupler or rail 73 to secure the ice storage bin 70 to the housing unit 52. The housing unit 52 further includes means for channeling ice 75 which is coupled to the chamber outlet 53*b*. The means for channeling ice 75 includes any one of a hose or tubing having a length of a few inches up to 10 feet or a chute. The hose or tubing of the means for channeling ice 75 has a diameter of approximately 1 inch. Furthermore, the front of the housing unit 52 is provided with a manual reset button 78 to allow occupants to manually reset the system 10.

In the preferred embodiment, the housing unit includes lid 76 and rear brackets 77 for affixing the housing unit 52 to a wall.

The remote ice making sub-assembly 50 includes a rotatable auger 54 rotatably mounted in a freeze chamber 66 and which is rotated by a high torque motor 56 connected via gear box 58 to the rotatable auger 54. Thereby, no other extruding mechanism is needed to force the ice through long conduits. The gear box 58 is stacked above the high torque motor 56. The freeze chamber 66 and auger 54 are stacked above the gear box 58.

The remote ice making sub-assembly 50 further includes an evaporator 60 which is coiled around the auger 54 and an insulating housing 64 encapsulating the evaporator 60. Refrigerant is supplied via the refrigerant delivery line 42*a* of the refrigerant delivery sub-assembly 40 from the compressor and condenser subassembly 20 to the refrigerant inlet line 61*a* of the evaporator 60. The refrigerant outlet line 61*b* of the evaporator 60 expels the spent refrigerant on return refrigerant delivery line 42*b*. The return refrigerant delivery line 42*b* delivers the spent refrigerant to the compressor and condenser sub-assembly 20.

The auger 54 is selectively rotated by motor 56 to scrap or shave the frozen water in the freeze chamber 66 and create ice 90. The fresh water from the fresh water reservoir 80, which includes a float 83, fills the freeze chamber 66.

Referring again to FIG. 2, the refrigeration circuit 100 will be described in more detail. The compressor and condenser sub-assembly 20 includes a compressor unit 22 which supplies a flowable gaseous refrigerant, such as refrigerant R-22, to the condenser unit 24 on the condenser refrigerant inlet line 25*a*. The condenser unit 24 cools or liquefies the gaseous refrigerant and outputs, on the condenser's outlet line 25*b*, the liquified refrigerant to the refrigerant inlet line 61*a* of the evaporator 60 via the refrigerant delivery line 42*a*. A TXV or thermo-expansion valve 45 for metering the refrigerant is coupled in-line between the refrigerant delivery line 42*a* and the refrigerant inlet line 61*a* of the evaporator 60.

The liquified refrigerant flows through the evaporator 60 and exits the evaporator at the refrigerant outlet line 61*b* and flows back to the compressor unit 22 where the refrigerant loop begins. As the liquified refrigerant flows through the evaporator 60, the water in the freeze chamber 66 freezes via heat transfer.

The evaporator 60 surrounding the exterior of the freeze chamber 66 causes the fresh water therein to freeze as the refrigerant flows therethrough. As the auger 54 rotates the frozen fresh water is shaved to create ice 90. Moreover, as the auger 54 rotates, the shaved ice 90 is channeled upward to chamber outlet 53*b* where ice 90 is expelled and stored in ice storage bin 70.

In the exemplary embodiment, the condenser unit 24 includes a water cooled, cooper-plated tubing having a raw water inlet line 26*a* and a raw water outlet line 26*b*. The raw water inlet line 26*a* receives raw water from the engine room or from outside the marine vessel 1. There is a conventional water controller valve 29 in inlet line 26*a* for controlling water in-take flow. As the raw water flows through the condenser unit 24, the spent raw water exits therefrom through the raw water outlet line 26*b*. The flow of the raw water through the condenser unit 24 is controlled via pumping unit 30.

The raw water inlet line 26*a* is an outer annular tubing and has concentric therethrough the condenser's refrigerant line (not shown) terminating between the condenser refrigerant inlet line 25*a* and the condenser refrigerant outlet line 25*b*. The raw water intake is controlled by the water controller 29 in line 26*a* which is controlled by the pressure of the system 10 for maximum efficiency of the system 10.

The water controller 29 is used in the system 10 to accommodate for a range of raw water temperatures such as from 40 degrees to 95 degrees Fahrenheit. The condensing unit 24 also has low and high pressure control.

The refrigeration circuit 100 further includes a control temperature sensor 85 integrated into or affixed to the ice storage bin 70. Thereby, as the ice level increases in the ice storage bin 70, the ice 90 will reach the sensor's level. The control temperature sensor 84 is temperature sensitive to the temperature of ice and coupled to thermostat 87. The control temperature sensor 85 deactivates the motor 56, the pump 30 and compressor unit 22 thereby deactivating the refrigeration circuit 100. In other words, the compressor and condenser sub-assembly 20 and the remote ice making sub-assembly 50 are deactivated.

Moreover, a water switch 82 is provided to maintain water pressure at a minimum of 10 psi. If the fresh water reaches below 10 psi, the system 10 will deactivate until the pressure reaches 10 psi. The system can be deactivated by providing a conventional safety switch or thermostat in bin 70.

In the exemplary embodiment, the voltage (V) is 230 V or 115 V single phase and is delivered on lines 1*a*, 1*b*, and 1*c*. Lines 2*a*, 2*b* and 2*c* are coupled to ground or common. In operation, when the temperature decreases as the result of a high ice level, the thermostat 87 switches off the voltage (V) delivered on lines 1*a*, 1*b* and 1*c*.

Extremely low temperatures are used to achieve a super low temperature in which the auger 54 rotated under the high torque motor 56 can shave the ice and produce super amount of ice in a small amount of time and with little water. This is achieved by the TXV 45 in conjunction with a condensing unit 24. For example, the system 10 can produce 380–500 pounds of ice per day.

The remote ice making sub-assembly 50 is designed to be compact so that it can be accommodated in a variety of locations where available space is constrained. In the exemplary embodiment, the remote ice making sub-assembly 50 has a height of approximately 29½ inches and a width and a depth of 10 inches. As can be appreciated, the remote ice making sub-assembly 50 can be stored under a cabinet, in a closet or on top of a counter. The housing unit 52 is made of aluminum, high temperature primer and baked on paint to protect the remote ice making sub-assembly 50 from salt water.

In the RV environment, in lieu of a water cooled condenser unit, an air cooled condenser is used. For example, a fan is substituted to cool the refrigerant with air.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A split ice making and delivery system carried on a transport vehicle having at least one compartment, wherein said system comprises:

an isolated compressor/condenser subassembly located and isolated in said one compartment for compressing and condensing a refrigerant to provide a cooled refrigerant;

a remote ice making subassembly disposed in a location remote from said one compartment adapted for connection to a supply of fresh water for producing ice, said ice making subassembly being further disposed in a location readily accessible to persons on the transport vehicle;

said ice making subassembly including a water freeze chamber for producing ice, said water freeze chamber having a chamber inlet for receiving said fresh water to produce said ice and a chamber outlet for delivering said ice out of said freeze chamber;

a rotating auger carried in said freeze chamber for conveying said ice through chamber outlet;

an ice storage bin located at said remote location adjacent to said ice making subassembly for receiving said ice directly from said chamber outlet and for storing said ice for access by the persons on said transport vehicle; and a refrigerant delivery line for delivering said cooled refrigerant from said isolated compressor-condenser unit to said remote ice making subassembly and a refrigerant return line for returning spent refrigerant from said ice making subassembly to said compressor/condenser unit; and said refrigerant delivery line effectively delivering said cooled refrigerant from said isolated compressor/condenser subassembly to said remote ice making subassembly over a long distance through said transport vehicle and said ice is delivered from said ice maker subsystem to said storage bin directly so that ice is accessible to persons on said transport vehicle without clogging of long ice delivery lines and with reduced noise.

2. The system of claim 1 wherein said ice storage bin is affixed in an adjacent position with respect to said freeze chamber so that ice from said freeze chamber outlet is reliably dispensed generally without any distance from said freeze chamber outlet into said storage bin.

3. The system of claim 2 including a housing covering said freeze chamber; and said ice storage bin being attached in a generally fixed position relative to said freeze chamber outlet wherein said ice is delivered directly from said freeze chamber to said ice storage bin by a short conduit extending from said housing into said storage-bin.

4. The system of claim 3 wherein said freeze chamber housing includes a first attachment coupler; and said ice storage bin includes a second attachment coupler adapted for connection to said first coupler to secure said ice storage bin and said housing together.

5. The system of claim 4 including an ice delivery channel for delivering said ice from said water freeze chamber to said adjacent storage.

6. The system of claim 1 wherein said freeze chamber includes an evaporator coil coiled around said auger having an evaporator inlet for receiving said cooled refrigerant from said refrigerant delivery line and an evaporator outlet which expels sad spent refrigerant into said refrigerant return line for delivery to said compressor/condenser subassembly.

7. The system of claim 1 including a sensor carried in said ice storage bin at a prescribed level for generating a signal to deactivate said ice making subassembly to stop the production of ice upon said ice reaching said prescribed level in said ice storage bin.

8. The system of claim 6 wherein said sensor further senses the temperature of the ice at said prescribed level.

9. A mobile split ice making and delivery system comprising:

a transport vehicle having at least one compartment an isolated compressor/condenser subassembly located and isolated in said one compartment for compressing and condensing a refrigerant to provide a cooled refrigerant;

a remote ice making subassembly disposed in a location remote from said one compartment adapted for connection to a supply of fresh water for producing ice, said ice making subassembly being further disposed in a location readily accessible to persons on the transport vehicle;

said ice making subassembly including a water freeze chamber for producing ice, said water freeze chamber having a chamber inlet for receiving said fresh water to produce said ice and a chamber outlet for delivering said ice out of said freeze chamber;

an ice storage bin located at said remote location adjacent to said ice making subassembly for receiving said ice from said chamber outlet and for storing said ice for access by the persons on said transport vehicle; and a refrigerant delivery line for delivering said cooled refrigerant from said isolated compressor/condenser unit to said remote ice making subassembly and a refrigerant return line for returning spent refrigerant from said ice making subassembly to said compressor/condenser unit; and said refrigerant delivery line effectively delivering said cooled refrigerant from said isolated compressor/condenser subassembly to said remote ice making subassembly over a long distance through said transport vehicle so that ice is accessible to persons on said transport vehicle without clogging of long ice delivery lines and with reduced noise.

10. The system of claim 9 wherein said ice storage bin is affixed in an adjacent position with respect to said freeze chamber so that ice from said freeze chamber outlet is reliably and directly dispensed from said freeze chamber into said storage bin.

11. The system of claim 9 including a housing covering said freeze chamber; and said ice storage bin being attached in a generally fixed position relative to said freeze chamber outlet wherein said ice is delivered directly from said freeze chamber outlet to said ice storage bin by a short conduit extending from said housing into said storage-bin.

12. The system of claim 9 including a sensor carried in said ice storage bin at a prescribed level for generating a signal to deactivate said ice making subassembly to stop the production of ice upon said ice reaching said prescribed level in said ice storage bin.

13. The system of claim 12 wherein said sensor further senses the temperature of the ice at said prescribed level.

14. The system of claim 11 including a rotating auger carried in said freeze chamber for conveying said ice through chamber outlet.

15. A split ice making and delivery system comprising:

(a) a condenser-compressor subassembly which compresses and condenses refrigerant;

(b) a remote ice making subassembly having a rotating auger, a fresh water freeze chamber adapted to be filled with portable fresh water and an outlet wherein rotation of said auger forces out of said outlet, ice product;

(c) a refrigerant delivery subassembly coupled to said condenser-compressor subassembly and said remote ice making subassembly for delivering there between said refrigerant wherein said refrigerant delivery subassembly has a length sufficient to reach a remote room or remote location and to reach said remote ice making subassembly remote from said condenser-compressor subassembly; and (d) a housing unit for housing said remote ice making subassembly, said housing unit comprises:

(i) means for channeling ice which is coupled to the outlet of said remote ice making subassembly;

(ii) a cover covering a top of said housing unit; and (iii) bracket elements for securing said housing unit to a stationary structure.

16. The system of claim 15 including a manual reset button to allow manual reset when said ice clogs said subassembly.

17. The system of claim 15 including a housing covering said freeze chamber; and said ice storage bin being attached in a generally fixed position relative to said freeze chamber outlet wherein said ice is delivered directly from said freeze chamber outlet to said ice storage bin by a short conduit extending from said housing into said storage bin.

18. The system of claim 17 wherein said freeze chamber housing includes a first attachment coupler; and said ice storage bin includes a second attachment coupler adapted for connection to said first coupler to secure said ice storage bin and said housing together.

19. The system of claim 15 including a sensor carried in said ice storage bin at a prescribed level for generating a signal to deactivate said ice making subassembly to stop the production of ice upon said ice reaching said prescribed level in said ice storage bin.

20. The system of claim 19 wherein said sensor further senses the temperature of the ice at said prescribed level.

* * * * *